US006389728B1

(12) United States Patent
Lundy

(10) Patent No.: US 6,389,728 B1
(45) Date of Patent: May 21, 2002

(54) PERSONAL FIREARM SAFETY MECHANISM

(76) Inventor: Gregory Warren Lundy, 1956 Lehigh St., Apt. 1, Cincinnati, OH (US) 45230

( * ) Notice: Subject to any disclaimer, the term of this patent is extended or adjusted under 35 U.S.C. 154(b) by 0 days.

(21) Appl. No.: 09/466,290

(22) Filed: Dec. 17, 1999

(51) Int. Cl.[7] ..... F41A 17/00

(52) U.S. Cl. ..... 42/70.11; 42/70.01

(58) Field of Search ..... 42/66, 67, 70.01, 42/70.02, 70.04, 70.05, 70.06, 70.08, 70.11

(56) References Cited

U.S. PATENT DOCUMENTS

| | | | | | |
|---|---|---|---|---|---|
| 2,563,720 | A | | 8/1951 | Guisasola | 42/70 |
| 2,599,132 | A | | 6/1952 | Sass | 42/70 |
| 3,462,869 | A | | 8/1969 | Wallace | 42/70 |
| 3,553,877 | A | | 1/1971 | Welch et al. | 42/70 |
| 3,882,622 | A | * | 5/1975 | Perlotto | 42/1 |
| 4,627,185 | A | * | 12/1986 | Rohm | 42/66 |
| 4,726,136 | A | | 2/1988 | Dornaus et al. | 42/70.08 |
| 4,768,302 | A | | 9/1988 | Beretta | 42/70.08 |
| 5,054,223 | A | * | 10/1991 | Lee | 42/70.11 |
| 5,216,191 | A | * | 6/1993 | Fox | 42/70.05 |
| 5,361,525 | A | * | 11/1994 | Bowes | 42/70.11 |
| 5,426,881 | A | * | 6/1995 | Ruger | 42/70.08 |
| 5,465,519 | A | * | 11/1995 | Blanck | 42/70.11 |
| 5,467,550 | A | | 11/1995 | Mumbleau | 42/70.11 |
| 5,581,927 | A | | 12/1996 | Meller | 42/70.11 |
| 5,918,402 | A | * | 7/1999 | Weinraub | 42/70.11 |
| 6,122,851 | A | * | 9/2000 | Perkins | 42/70.11 |

FOREIGN PATENT DOCUMENTS

| | | | |
|---|---|---|---|
| CH | 0198439 | * | 9/1938 |
| GB | 2215822 A | * | 9/1989 |
| WO | WO-8203120 | * | 9/1982 |

* cited by examiner

*Primary Examiner*—Michael J. Carone
*Assistant Examiner*—Denise J Buckley
(74) *Attorney, Agent, or Firm*—Troutman Sanders LLP; Wm. Brook Lafferty

(57) ABSTRACT

A personalized locking mechanism for firearms. The locking mechanism of the present invention comprises an axial opening in an end of a safety cam of a firearm. The safety cam is rotated relative to a slide of a firearm to place the firearm in the safe and firing positions. A key-operable lock cylinder is received in the axial opening. A pair of holes is placed through the exterior surface of the slide and through the exterior surface of the safety cam. When the safety cam is rotated into the safe position, the pair of holes in the safety cam and the pair of holes in the slide correspond. In the safe position, a portion of each of a pair of lock pins may be received in each of the holes in the slide and in the safety cam to define a locked condition. A personalized key engages the lock cylinder to remove the lock pins from the holes in the slide to then define an unlocked condition. In the unlocked condition, the safety cam is permitted to rotate between the safe and firing positions.

7 Claims, 4 Drawing Sheets

PERSONAL FIREARM SAFETY MECHANISM

TECHNICAL FIELD

The present invention relates to a safety mechanism for firearms, more specifically, it relates to modifying the safety presently existing on many semi-automatic handguns to include a personalized key.

BACKGROUND OF THE INVENTION

Various types of locking mechanisms for firearms are commercially available for preventing accidental or unintentional discharges. These known locking mechanisms include bore locks which have an elongated bar that is placed into the barrel of the firearm, trigger guard locks that prevent a finger from moving the trigger rearward, and frame mounted locks such as a manual safety. However, these known locking mechanisms have proven impractical and unreliable.

Currently, local governments, legislators and gun manufacturers are litigating whether firearms are inherently safe. The gun manufacturers are accused of not providing the safest firearms possible because the firearms are not equipped with personalized locking mechanisms. A firearm which is personalized to its owner will reduce accidental or unintentional discharging of a firearm.

Although some known locking mechanisms include key or combination locks, these locking mechanisms are not typically included as a feature of the firearm when the firearm is originally manufactured. Moreover, these known locking mechanisms are not esthetically pleasing when utilized on a firearm. Consequently, many firearm enthusiasts do not use these known locking mechanisms.

Another undesirable feature typical of most known locking mechanisms is that they may become separated from the firearm. In the event that the locking mechanism has been removed to permit firing, the locking mechanism is then no where to be found when the weapon is to be stored in a safe manner. On the other hand, where the known locking mechanism is permanently attached to the weapon, the locking mechanism alters the appearance of the firearm from its original design.

Therefore, there is a need for a reliable locking mechanism for firearms which is esthetically-pleasing to gun enthusiasts. This new locking mechanism must be capable of being included on many newly manufactured firearms as well as being adaptable for use with firearms already in the possession of the public. The new locking mechanism must also allow a gun owner to secure his firearm in a personalized manner.

SUMMARY OF THE INVENTION

The present invention solves the above-identified problems by providing an esthetically-pleasing, personalized locking mechanism for firearms. The present invention seeks to provide a personalized locking mechanism which is included as an integral feature on a firearm.

Generally described, the personalized locking mechanism of the present invention comprises a safety cam rotatably mounted on a slide of a semi-automatic firearm. The safety cam rotates in the slide between safe and firing positions. In the safe position, the safety cam blocks the hammer from striking the firing pin and, in the firing position, the safety cam permits the hammer to strike the firing pin. Alternatively, the safety cam disengages the trigger and hammer rendering the weapon inoperable.

The safety cam includes an axial opening in one of its ends and a key-operable lock cylinder is sized to be received and retained in the axial opening. The lock cylinder includes at least a pair of lock pins in a pair of corresponding holes which pass through the exterior of the lock cylinder. The safety cam and the slide also include at least a pair of holes through their exterior surfaces. The holes in the lock cylinder, the safety cam, and the slide are capable of communicating with each other during the rotational movement of the safety cam in the slide.

The safety cam also includes a pair of lock pins sized to be received in the holes in the safety cam and the slide. In the safe position, a portion of the lock pins may be received into the safety cam and into the slide to prevent the rotation of safety cam relative to the slide. The safety cam is locked when prevented from rotating. A personalized key is utilized to lock and unlock the safety cam in the safe position as well as rotate the safety cam between the safe and firing positions.

The foregoing has outlined rather broadly, the more pertinent and important features of the present invention. The detailed description of the invention that follows is offered so that the present contribution to the art can be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

DETAILED DESCRIPTION

The present invention permits locking and unlocking of a firearm in a personalized manner. Although the present invention may be utilized in a variety of firearms, the operation and feasibility of the present invention will be demonstrated by describing a specific embodiment. Alternate exemplary embodiments of the present invention can exist on many other types of firearms.

Figure 1:
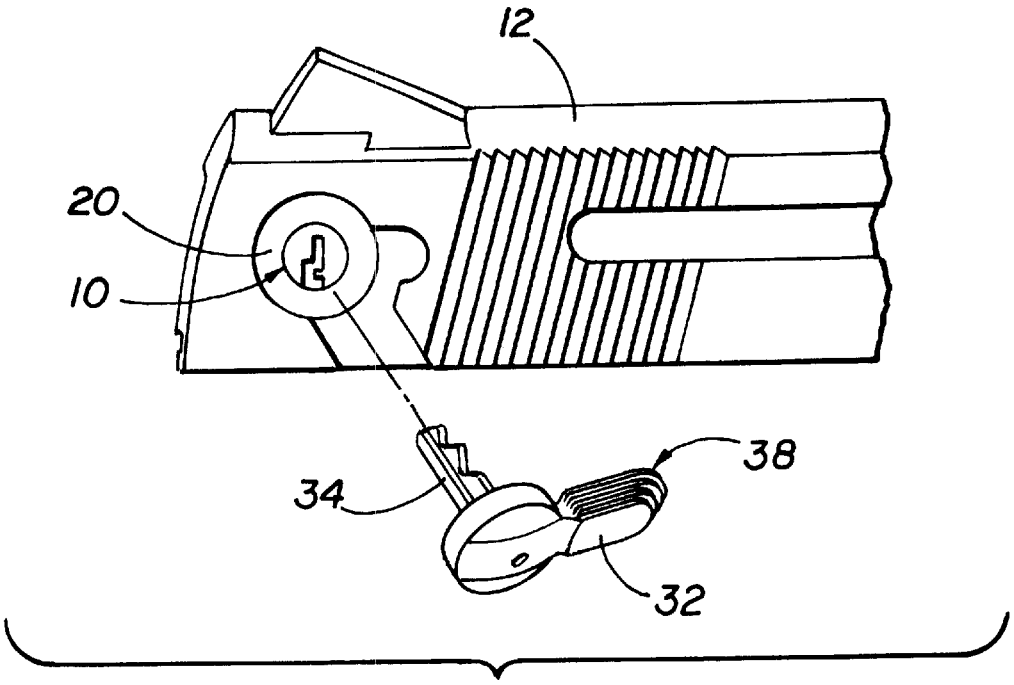
FIG. 1 is a side view of an exemplary embodiment of the locking mechanism of the present invention in a section of a slide of a firearm.

Referring now to the drawings in which like numerals indicate like elements throughout the several views, FIG. 1 illustrates an exemplary embodiment of a locking mechanism 10 in a partial view of a slide 12 of a firearm. The locking mechanism 10 utilizes a cylindrical safety cam 20 commonly found mounted in the slide 12 of many semi-automatic firearms. Typically, the safety cam 20 is manufactured to rotatably mount in the slide 12 and may be removed from the slide 12 during disassembly of the firearm.

Figure 2:
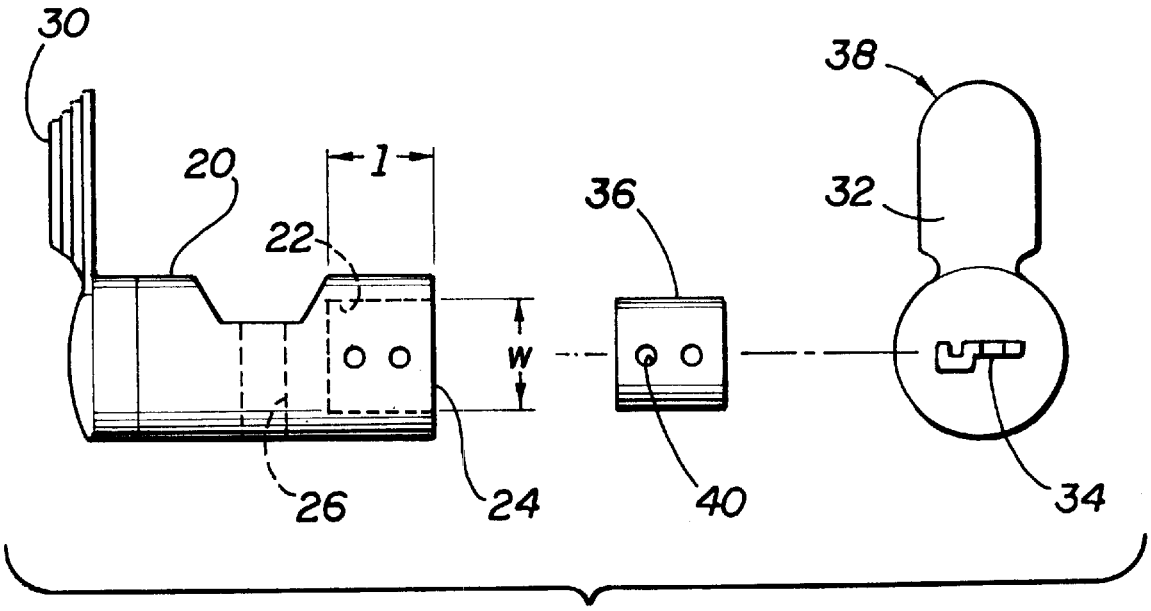
FIG. 2 is an exploded side view of one embodiment of a safety cam modified to receive a locking cylinder.
Figure 3:
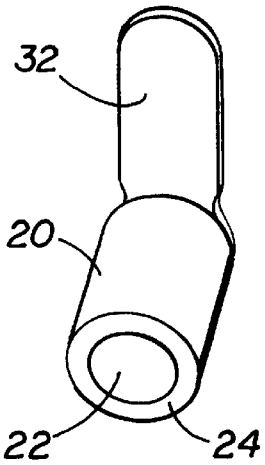
FIG. 3 is a perspective view of one embodiment of the safety cam of the present invention illustrating, in particular, an axial opening in one end of the safety cam.

Many commercially available firearms have safety levers on each end of the safety cam. As shown in FIG. 2, the safety cam 20 includes safety levers 30 and 32. In FIG. 2, however, the safety lever 32 has been removed from the end 24. The safety lever 32 may be removed from end 24 by electronic discharge machining (EDM). EDM is a process where an electrically charged wire cuts through the part with precision to make a very clean cut with minimal waste. By removing the safety lever 32 from the safety cam 20, an axial opening 22 may be drilled into an end 24 of the safety cam 20 with a drill press (not shown). The axial opening 22 is best shown in FIGS. 2 and 3. Alternatively, the axial opening 22 may be placed in to the end of the safety cam 20 by other methods, such as forging or casting, known to those skilled in the art of manufacturing firearm components.

As shown in FIG. 2, the axial opening 22 has an axial length l and a perpendicular width w. Preferably, the axial opening 22 in the safety cam 20 is sized with the axial length l at least equal to the perpendicular width w of the axial opening 22. The length l of the axial opening 22 in the safety cam 20 is limited by the portion of the safety cam 20 which permits the firing pin (not shown) to be contacted by the hammer (not shown) when the safety cam 20 is rotated into the firing position. For example, the safety cam 20 in FIG. 2 includes a passage 26 which permits the firing pin to be contacted by the hammer. However, the safety cam 20 may be configured in a manner other than shown to permit contact with the firing pin by the hammer.

The locking mechanism 10 of the present invention also includes a key-operable lock cylinder 36 for engaging a personalized key 38. As best shown in FIGS. 1 and 2, the personalized key 38 includes a teeth portion 34 mounted to the lever 32. The original head portion (not shown) of the key is removed and the lever portion 32 becomes the new head portion for teeth portion 34.

Figure 4:
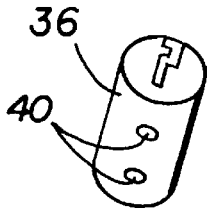
FIG. 4 is a perspective view of one embodiment of the lock cylinder of the present invention.

FIG. 4 is a perspective view of one embodiment of the lock cylinder 36. The lock cylinder 36 may be obtained for use with the present invention by removing it from a commercially available lock (not shown). For example, a padlock from the Master Lock Co. in Milwaukee, Wis., has a lock cylinder suitable for use in the present invention. The w of the axial opening 22 is dependent on the diameter of the lock cylinder selected. The length of the lock cylinder 36 may be varied by removing a portion of its length so that it is properly sized to be received in the axial opening 22. One method of altering the length of the lock cylinder 36 is by sawing. A properly sized lock cylinder 36 may be secured in the axial opening 22 with an adhesive.

The lock cylinder 36 includes a pair of holes 40 through its exterior surface which correspond with a pair of holes 44 in the safety cam 20. The lock cylinder 36 also includes a pair of lock pins 42 for the pair of holes 40, respectively. The holes 44 extend through the exterior surface of the safety cam 20 and communicate with the axial opening 22. The holes 44 also communicate with the lock cylinder 36 when the lock cylinder 36 is secured within the axial opening 22.

Figure 5:
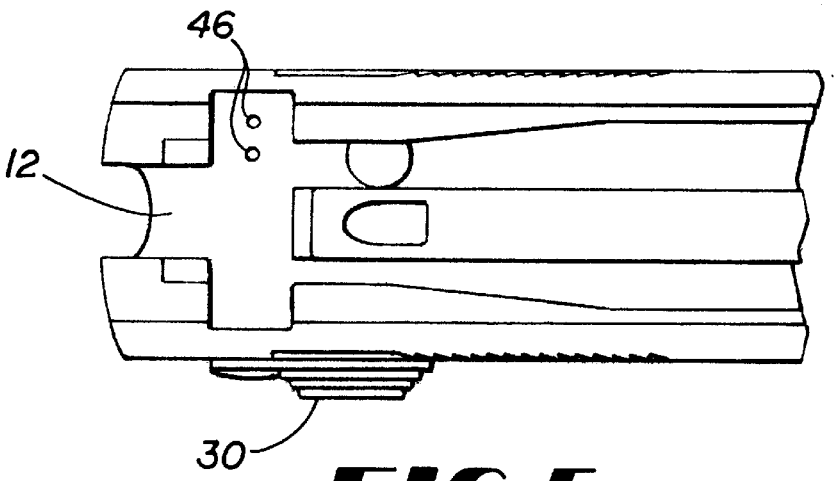
FIG. 5 is a partial bottom view of one embodiment of the slide illustrating a pair of holes in the exterior of the slide.
Figure 6:
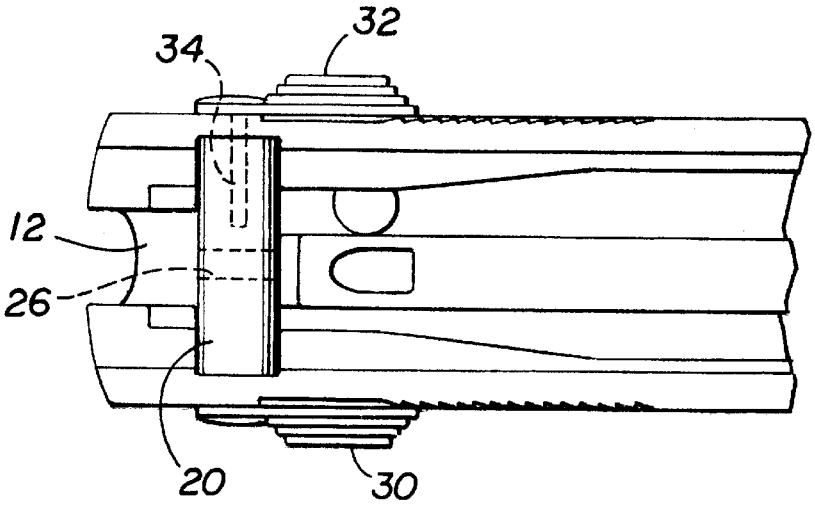
FIG. 6 is a partial bottom view of one embodiment of the slide with the safety cam rotatably mounted therein.

As best shown in FIG. 5, the slide 12 also includes a pair of holes 46. The holes 46 extend through the exterior surface of the slide 12 and communicate with the safety cam 20 when the safety cam 20 is rotatably mounted in the slide 12. Preferably, the holes 46 are angled relative to the bottom exterior surface of slide 12. The particular angle depends on the desired position of the levers 30, 32 along side the slide 12 when in the safe and firing positions. In FIG. 6, the safety cam 20 is shown mounted over the holes 46 in the slide 12. The holes 46 may be drilled into the slide 12 with a milling machine or the slide 12 may be manufactured by the firearm manufacturer already with the holes 46 by methods known in the art.

A pair of lock pins 50 are sized to be received in the holes 44 and 46. As explained above, the safety cam 20 may be rotated relative to the slide 12 between safe and firing positions. When the key 38 is in the lock cylinder 36, the safety cam 20 can be rotated out of the safe position and into the firing position by flipping either of the safety levers 30, 32. When the safety cam 20 is rotated into the safe position, the holes 44 in the safety cam 20 and the holes 46 in the slide 12 correspond with one another, as best shown in FIGS. 7–10. When the holes correspond with one another, the safety cam 20 may be locked and unlocked by removing and inserting the key 38, respectively.

Figure 7:
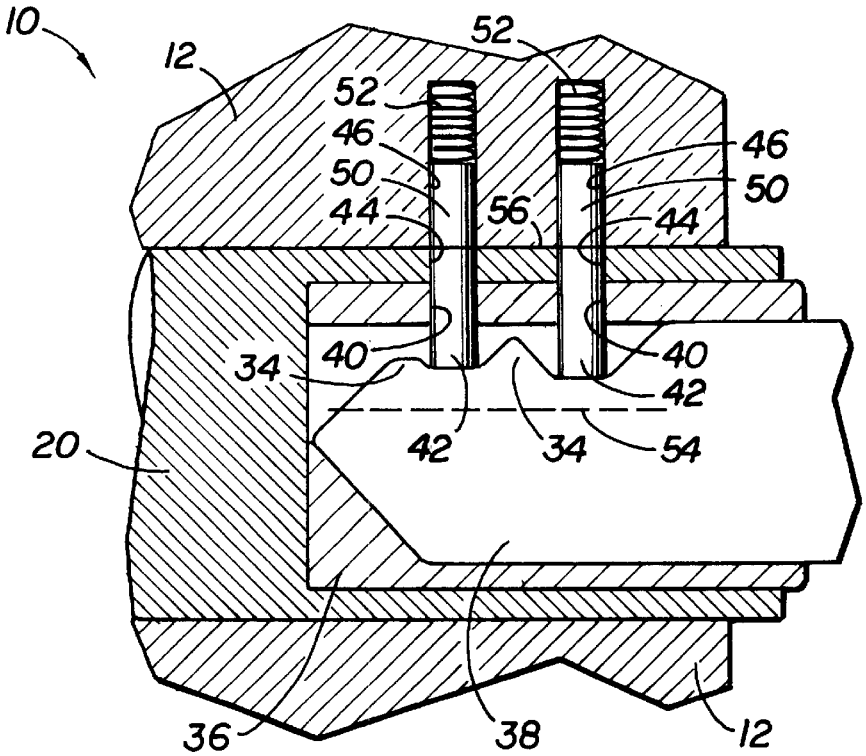
FIG. 7 is a partial cross-section view of the safety cam and lock cylinder having a personalized key inserted therein and illustrating the alignment of locking pins to permit the safety cam to rotate in the slide.
Figure 8:
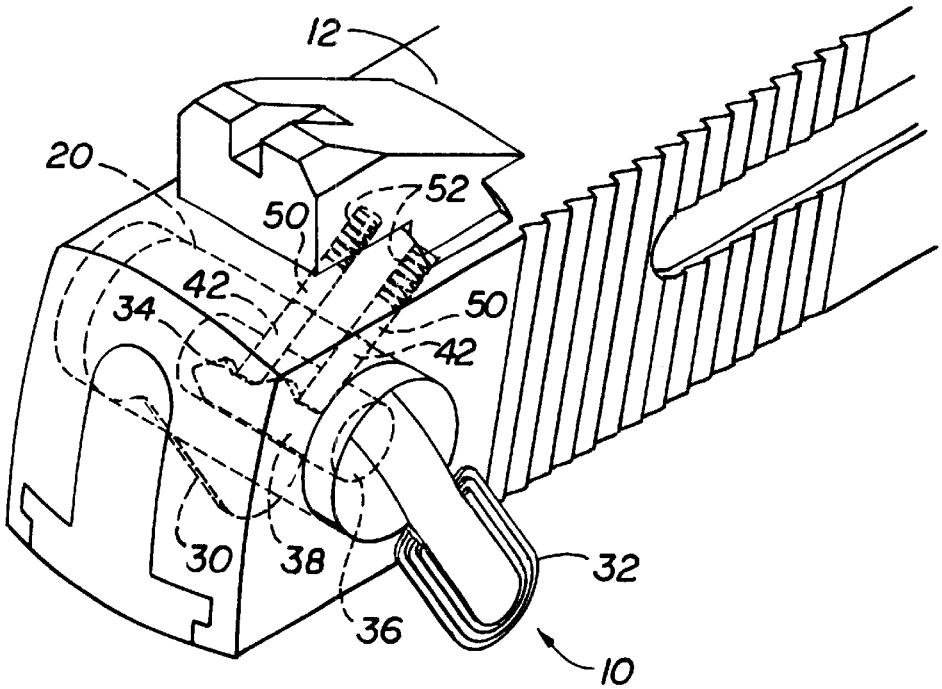
FIG. 8 is a perspective view of a partial section of the slide with the locking mechanism of the present invention positioned to allow the safety cam to rotate relative to the slide.
Figure 10:
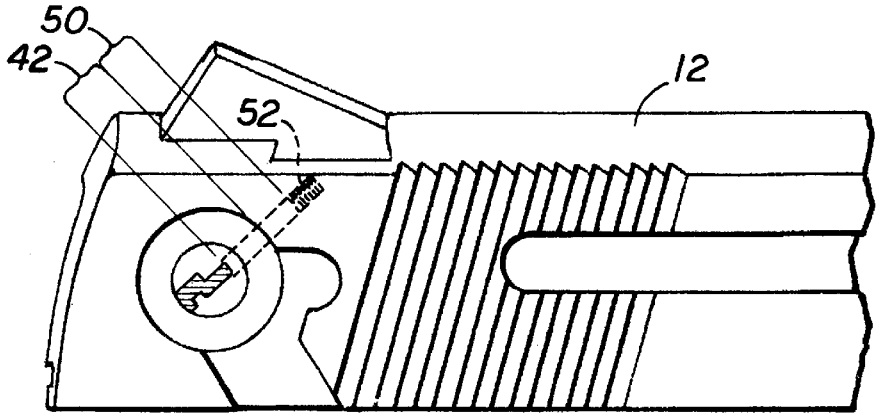
FIG. 10 is a side view of one embodiment of the locking mechanism of the present invention illustrating the positions of the locking pins when the firearm is unlocked in the safe position and the personalized key (FIGS. 1 and 8) inserted in the locking mechanism.

When the teeth portion 34 of the key 38 is inserted into the lock cylinder 36 as shown in FIGS. 7 and 8, the pins 42 in the lock cylinder 36 are contacted by the teeth of the key 38. The lock pins 42 contacted by the teeth of the key 38 raise the lock pins 50 out of the safety cam 20 so that the safety cam 20 is free to rotate relative to the slide 12. As shown in FIG. 7, a break line 56 is defined between the lock pins 42, 50, the safety cam 20, and the slide 12 when the lock pins 50 no longer protrude into the safety cam 20. When the firearm is in the safe position, the key 38 is held into place in the lock cylinder 36 by springs 52 acting on the locking pins 42 and 50. FIG. 10 shows a side view of the positioning of the lock pins 42 and 50 with the firearm in the safe position when the key 38 is installed.

Figure 9:
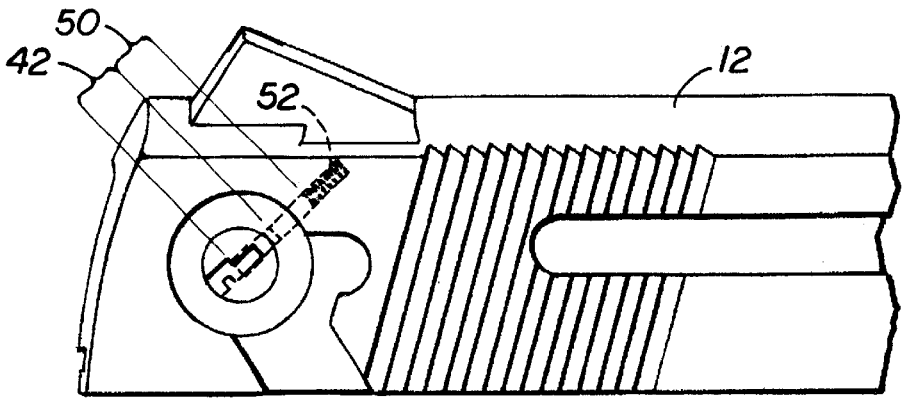
FIG. 9 is a side view of one embodiment of the locking mechanism of the present invention illustrating the positions of the locking pins when the firearm is locked in the safe position and the personalized key removed.

When the teeth portion 34 of the key 38 is removed from the lock cylinder 36, as shown in FIG. 9, a locked condition exists where portions of each lock pin 50 are retained in the slide 12 as well as the safety cam 20. The springs 52 push a portion of each of the lock pins 50 into the safety cam 20 so that the lock pins 42 are pushed back into lock cylinder 36. The lock pins 42 may be pushed back into the lock cylinder 36 to a lower limit defined in FIG. 7 by the line 54. When the lock pins 50 are retained in the safety cam 20 as well as in the slide 12, the safety cam 20 is prevented from rotating relative to the slide 12.

Figure 11:
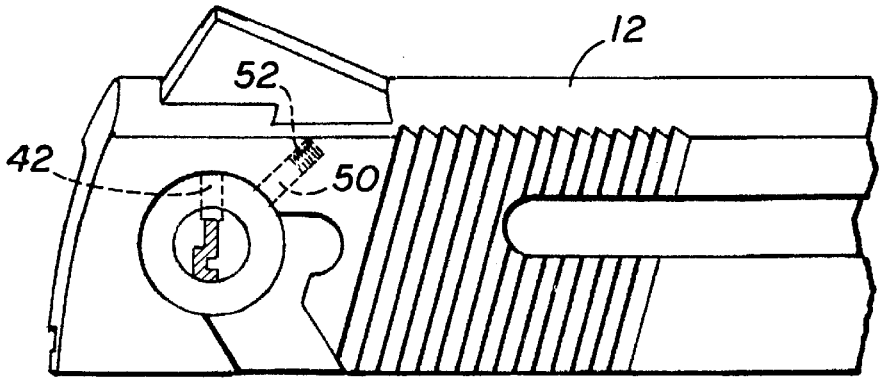
FIG. 11 is a side view of one embodiment of the locking mechanism of the present invention illustrating the positions of the locking pins when the firearm is placed in the firing position and the personalized key (FIGS. 1 and 8) inserted in the locking mechanism.

By rotating the safety cam 20 into the firing position, the holes 44 in the safety cam 20 no longer correspond with the holes 46 in the slide 12, as shown in FIG. 11. The lock pins 42 are then fully retained in the lock cylinder 36 and the lock pins 50 are fully retained in the slide 12. The key 38 may not be removed from the lock cylinder 36 while the firearm is in the firing position because the lock pins 42 are not free to move up and down in the lock cylinder 36. In other words, the lock pins 42 are encased in the lock cylinder 36.

Although the above described embodiment describes only a pair of holes 40, 44, 46 on each of the slide 12, the safety cam 20, and the lock cylinder 36, respectively, the present invention includes embodiments which may have any number of holes. The number of possible key combinations is limited by the available space in the cam cylinder 20 for receiving the lock cylinder 36. The greater number of holes and lock pins, the greater number of combinations for a personalized key. The above-described embodiment is disclosed with only sixteen possible combinations as a result of having only a pair of holes with corresponding lock pins 42 in the lock cylinder 36. Preferably, the slide 12, the safety cam 20 and the lock cylinder 36 are each manufactured with as many holes as possible to include as many possible key combinations as possible.

In an ideal situation, this invention would be used in the manufacture of new firearms. It may easily be incorporated without any redesign of the firearm itself, only the redesign of safety cam and the incorporation of a couple of machine operations into the manufacturing of the slide.

If the safety cam is manufactured with the key way and lock pin holes in it, it would eliminate the need to modify existing parts. This could be easily accomplished by those skilled in the art. Also with parts interchangability common among gun manufacturers, just a few parts may fit several or all of the models produced from one basic design. In the case of Smith & Wesson, the same part might be used in firearms 40 years old.

From the foregoing description, it will be appreciated that the present invention provides a personalized locking mechanism for locking firearms in the safe position. The present invention has been described in relation to particular embodiments which are intended in all respects to be illustrative rather than restrictive. Those skilled in the art will recognize that the present invention is capable of many modifications and variations without departing from the scope of the invention. Accordingly, the scope of the present invention is described by the appended claims and supported by the foregoing description.

What is claimed is:

1. A locking mechanism for a firearm, the firearm having a slide and a safety cam, the safety cam mounted in the slide for rotational movement relative to the slide to place the firearm in safe and firing positions, said locking mechanism comprising:

an axial opening in one end of the safety cam;

a key-operable lock cylinder sized to be received and retained in said axial opening in the safety cam, said lock cylinder having at least a pair of holes through an exterior surface of the lock cylinder;

at least a pair of holes through an exterior surface of the safety cam and in communication with said lock cylinder in said axial opening;

at least a pair of holes through an exterior surface of the slide;

at least a pair of lock pins sized to be received in said pairs of holes in said safety cam and the slide, said pair of holes in the safety cam corresponding with said pair of holes in said lock cylinder and the slide when the firearm is in the safe position, a portion of each of said lock pins capable of being received and retained in said pairs of holes in the safety cam and the slide when the firearm is in the safe position to prevent the safety cam from rotating relative to the slide and to thereby define a locked condition, said pair of holes in the safety cam not corresponding with said pair of holes in the slide when the firearm is in the firing position, and said lock pins capable of being received and retained in said pair of holes is said slide to permit the safety cam to be rotated between the safe and firing positions and to thereby define an unlocked condition.

2. The locking mechanism of claim 1 further comprising at least a pair of springs sized to be received and retained in said holes in the slide, respectively.

3. The locking mechanism of claim 1 further comprising a personalized key for engaging said lock cylinder, rotating the safety cam relative to the slide between the safe and firing positions, and to place the safety cam in said locked and un locked conditions when the firearm is in the safe position.

4. The locking mechanism of claim 3 wherein said personalized key is only removable from said lock cylinder to place the safety cam in said locked condition when the firearm is in the safe position.

5. The locking mechanism of claim 3 wherein said key includes a head portion substantially shaped like a safety lever.

6. The locking mechanism of claim 1 wherein said axial opening in said cam safety is sized with an axial length at least equal to a perpendicular width of said axial opening.

7. A safety cam for a firearm, said safety cam to be rotationally mounted in a slide of the firearm, the slide having at least a pair of holes through an exterior surface of the slide, said safety cam comprising:

an axial opening in one end of said safety cam;

a key-operable lock cylinder sized to be received and retained in said axial opening in said safety cam, said lock cylinder having at least a pair of holes through an exterior surface of said lock cylinder;

at least a pair of holes through an exterior surface of said safety cam which communicate with said lock cylinder in said axial opening, said safety cam configured to rotate in the slide between a safe position where said pair of holes in said safety cam correspond with said pair of holes in the slide and a firing position where said pair of holes in said safety cam do not correspond with said pair of holes in the slide; and at least a pair of locking pins operable to lock and unlock the safety cam in the slide of the firearm, a portion of each of said lock pins capable of being received and retained in each of said holes in said safety cam and said slide when the firearm is in the safe position to prevent the safety cam from rotating relative to the slide and to thereby define a locked condition, and said lock pins capable of being received and retained in said pair of holes in said slide to permit the safety cam to be rotated between the safe and firing positions and to thereby define an unlocked condition.

* * * * *